US006122781A

United States Patent [19]

Stephenson

[11] Patent Number: 6,122,781

[45] Date of Patent: Sep. 26, 2000

[54] FIRE FIGHTERS BEDDING

[76] Inventor: James R. Stephenson, 97 Locust Ave., Mill Valley, Calif. 94941

[21] Appl. No.: 09/186,035

[22] Filed: Nov. 4, 1998

[51] Int. Cl.[7] ..... A47G 9/02

[52] U.S. Cl. ..... 5/482; 5/486; 5/502

[58] Field of Search ..... 5/482, 485, 486, 5/493, 494, 495, 496, 499, 500, 502, 413 R; 40/661

[56] References Cited

U.S. PATENT DOCUMENTS

| | | | |
|---|---|---|---|
| 1,269,276 | 6/1918 | Harris | 5/485 X |
| 1,284,046 | 11/1918 | Blocksom | 5/413 R |
| 3,508,285 | 4/1970 | Marquette | 5/502 |
| 4,274,169 | 6/1981 | Standiford | 5/485 X |
| 4,309,784 | 1/1982 | Cohen | 40/661 X |
| 4,839,934 | 6/1989 | Rojas | 5/486 X |
| 5,005,235 | 4/1991 | Huang | 5/413 R |
| 5,072,466 | 12/1991 | Bond et al. | 5/413 R |
| 5,287,573 | 2/1994 | Ritacco | 5/486 |
| 5,566,411 | 10/1996 | Eiler | 5/494 |
| 5,655,236 | 8/1997 | Murray | 5/495 |
| 5,706,532 | 1/1998 | Kettenhofen | 5/413 R |
| 5,720,058 | 2/1998 | Hollander et al. | 5/486 X |
| 5,732,424 | 3/1998 | Bond | 5/502 |
| 5,898,962 | 5/1999 | McNeal | 5/485 X |

FOREIGN PATENT DOCUMENTS

| | | | |
|---|---|---|---|
| 356594 | 3/1990 | European Pat. Off. | 5/482 |
| 2305154 | 11/1976 | France | 5/413 R |
| 2396490 | 3/1979 | France | 5/413 R |
| 3235088 | 3/1984 | Germany | 5/502 |
| 2211731 | 7/1989 | United Kingdom | 5/496 |

*Primary Examiner*—Terry Lee Melius
*Assistant Examiner*—Robert G. Santos

[57] ABSTRACT

Fire Fighters Bedding with: an integrated folded cloth construction of a top side, a bottom side and skirt surround, each side being comprised of an upper cloth piece and a lower cloth piece and an amount of insulating material trapped within the upper and lower cloth pieces by means of sewing the perimeter of the cloth pieces. One the side has thin insulation and the other the side has thick insulation. A removable, cleanable sheet is held removably in place in the inside cavity formed by the folded top side and bottom side. A slit at both ends of the folded portion of said top side and said bottom side and well as the folded portion of the sheet allows for folding the end portion of the bedding when in use. A preferred embodiment includes the sheet being held in place by a fastener such as snaps or velcro.

3 Claims, 6 Drawing Sheets

FIRE FIGHTERS BEDDING

BACKGROUND OF THE INVENTION

This invention relates generally to the field of bedding, and more particularly to fire fighters bedding.

Bedding of various types has been used by mankind for thousands of years in the process of covering ones self while lying horizontally, usually for the purpose of sleeping.

For the last hundred years people in Europe and the United States have adopted a bedding style that includes a bottom sheet which covers a resilient mattress, a top sheet, a blanket or quilt located above the top sheet and in some cases, a bed spread which is a top covering that protects the bedding and also gives a neat and finished look to the bed because it also has a skirt that surrounds the bedding and mattress. Fire fighters have specific needs with regard to bedding. Although normal bedding as described above is relatively comfortable and serviceable, it has certain drawbacks with regard to the needs of fire fighters who spend a portion of their time in a fire house. Typically a fire fighter will spend three or four days in the fire house. There are bedrooms in the fire house for the fire fighters. Sometimes there are a plurality of fire fighters per bedroom. At the end of the three or four day shift the fire fighter must take his or her bedding off the bed to make way for the next fire fighter who will be taking the next shift and using the same bed. The act of removing the bedding and carrying it home as well as replacing the bedding for the next use is time consuming and cumbersome. Some fire fighters resort to using a sleeping bag such as campers use, however, this type of bedding is unsightly on a raised mattress because the sleeping bag does not cover the sides of the bed. Additionally, sleeping bags usually have a generous amount of insulation in them so that a camper can be comfortable in a cold outdoor environment. This feature makes them somewhat uncomfortable in a warm indoor environment.

Finally, a fire fighter needs to be able to make up his or her bedding quickly in the event that he or she is called to a fire at night. The time taken to straighten out normal bedding consisting of assorted sheets,blankets and bed spreads can take valuable time away from the task of getting to and fighting a fire.

SUMMARY OF THE INVENTION

The primary object of the invention is to provide ideal bedding for fire fighters.

Another object of the invention is to provide bedding that is quick to set up and take down.

Another object of the invention is to provide bedding that can be used with comfort both in warm and cold environments.

Another object of the invention is to provide bedding that can be accessed from either end depending on the location of the bed within a room Another object of the invention is to provide bedding in which the inner sheet is removably attached for the purpose of cleaning.

Another object of the invention is to provide bedding that can be easily rolled up and secured for transporting.

Another object of the invention is to provide bedding that has an integral skirt that surrounds the mattress.

Another object of the invention is to provide bedding that has a place for the owner to record his or her name for identification purposes.

Other objects and advantages of the present invention will become apparent from the following descriptions, taken in connection with the accompanying drawings, wherein, by way of illustration and example, an embodiment of the present invention is disclosed.

Fire Fighters Bedding comprising : an integrated folded cloth construction of a top side,a bottom side and skirt surround, each said side being comprised of an upper cloth piece and a lower cloth piece and an amount of insulating material trapped within said upper and lower cloth pieces by means of sewing the perimeter of said cloth pieces, one said side having thin insulation and the other said side having thick insulation, a removable, cleanable sheet held removably in place in the inside cavity formed by said folded top side and bottom side, a slit at both ends of the folded portion of said top side and said bottom side as well as said sheet to allow for folding down when in use.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
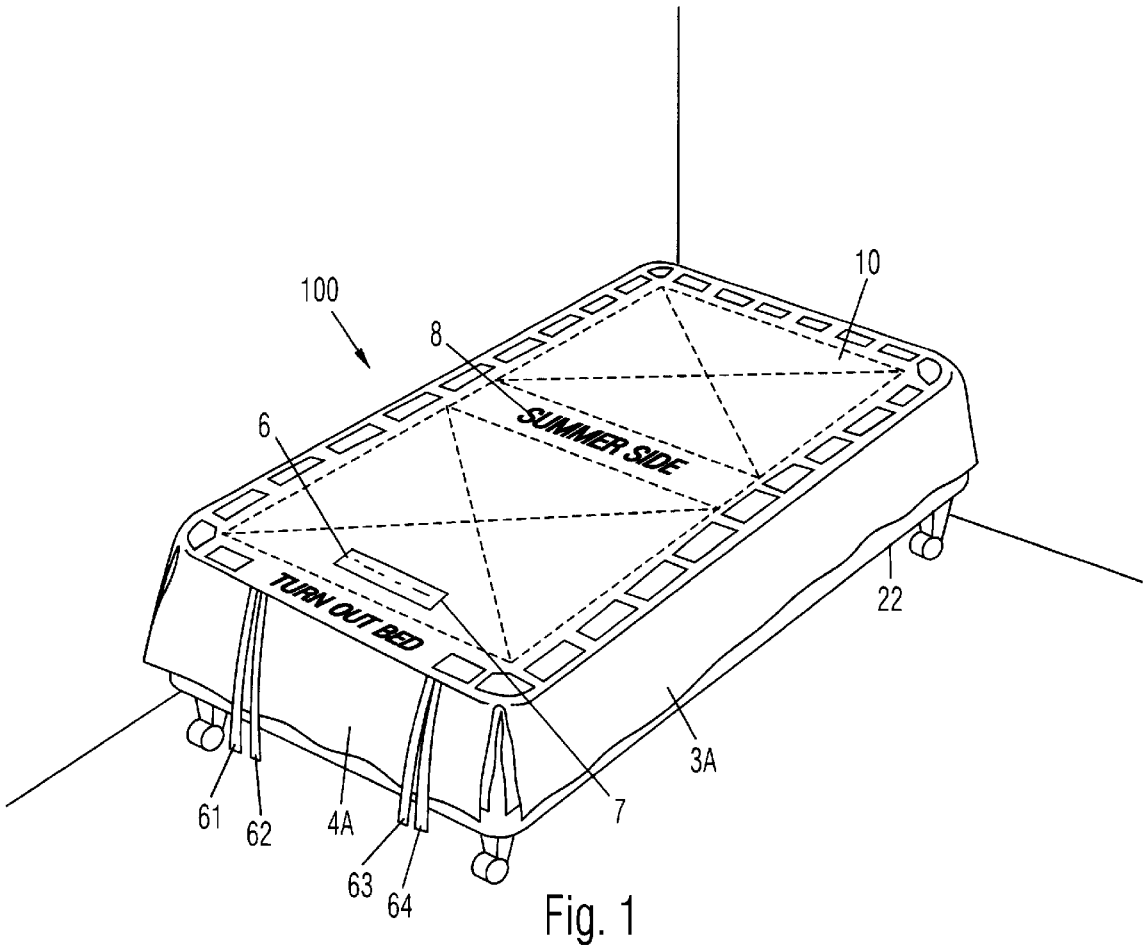
FIG. 1 is a perspective view of the fire fighters bedding of the present invention in the made up, folded mode.
Figure 2:
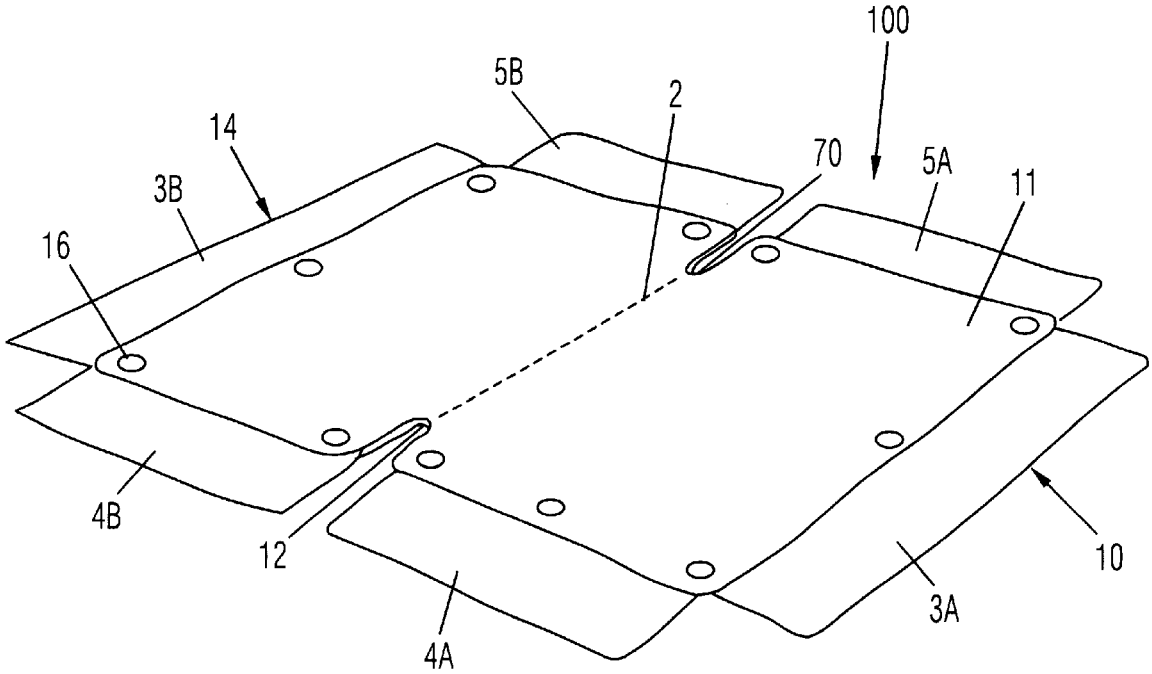
FIG. 2 is a perspective view of the bedding of the present invention in the open, unfolded mode
Figure 3:
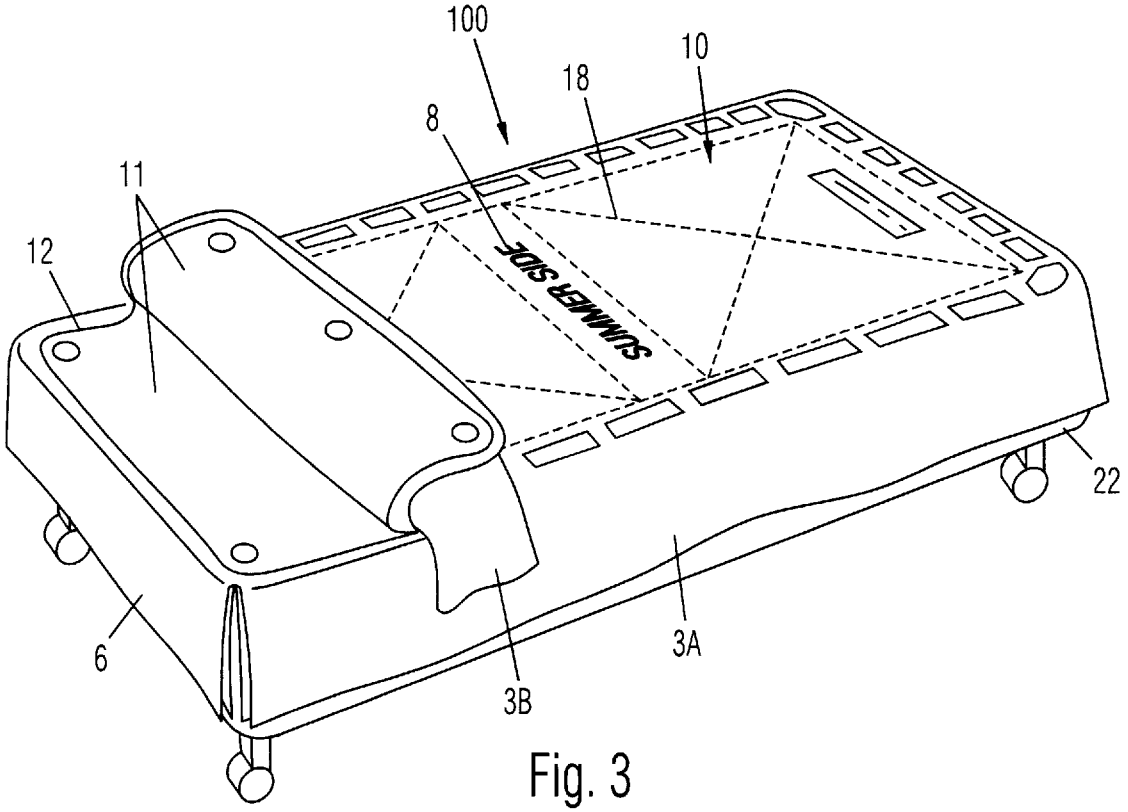
FIG. 3 is a perspective view of the bedding of the present invention with one end turned down.

Referring now to FIG. 1 we see the fire fighters bedding 100 of the present invention in place on a mattress and associated bed frame 22. The overall appearance is of a neat, fully made up bed. A skirt 3A, 4A is integral to to top cover 10 thereby concealing the mattress and bed frame 22. Lettering 8 indicates that this side of the bedding 10 is the lighter or Summer Side. Sewn on clear window 6 is open at one end 7 allowing a person to insert a card with his or her name printed on it. Attached straps 61,62,63,64 are used to secure the bedding 100 when in a rolled position as shown if FIG. 6. FIG. 2 shows the bedding 100 of the present invention in the unfolded position. A removable and replaceable sheet 11 covers the entire surface of the bedding underneath and is held in place by velcro fasteners 16 or snaps. Slits 70,12 allow the bedding to be turned down as shown in FIG. 3. Skirts 3A,3B,4A,4B,5A,5B are such that the outer appearance of the bedding 100 looks like a conventional made up bed whether surface 14 is top most or whether surface 10 is top most. Dotted line 2 indicates where bedding 100 is folded therby creating top and bottom bedding 10,14.

Figure 4:
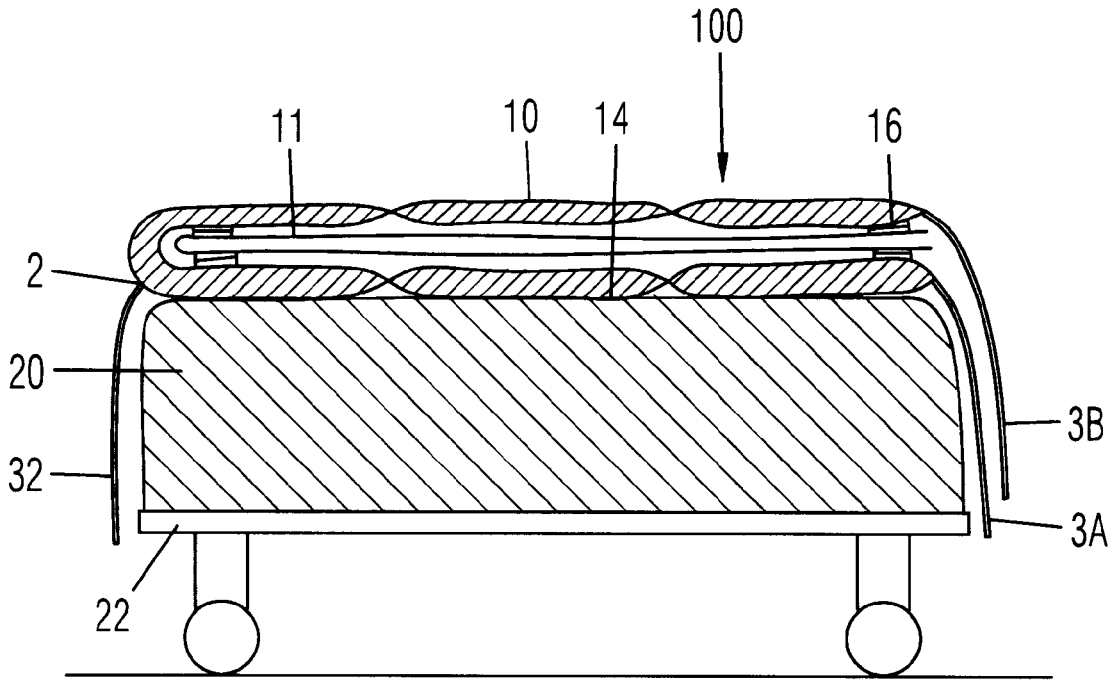
FIG. 4 is a side section view of the bedding of the present invention.

FIG. 4 shows a side section view of the bedding 100 of the present invention. Note that skirts 3A,3B overlap so that if the bedding were to be flipped upside down skirt 3A would be on the outside and the overall appearance of the bedding would still look like a conventional made up bed with bed spread. Skirt 32 is sewn to the bedding at the fold 2 so that even if the bed is seen from the left side, it has a fully made up appearance by concealing mattress 20 and bed frame 22.

Figure 5:
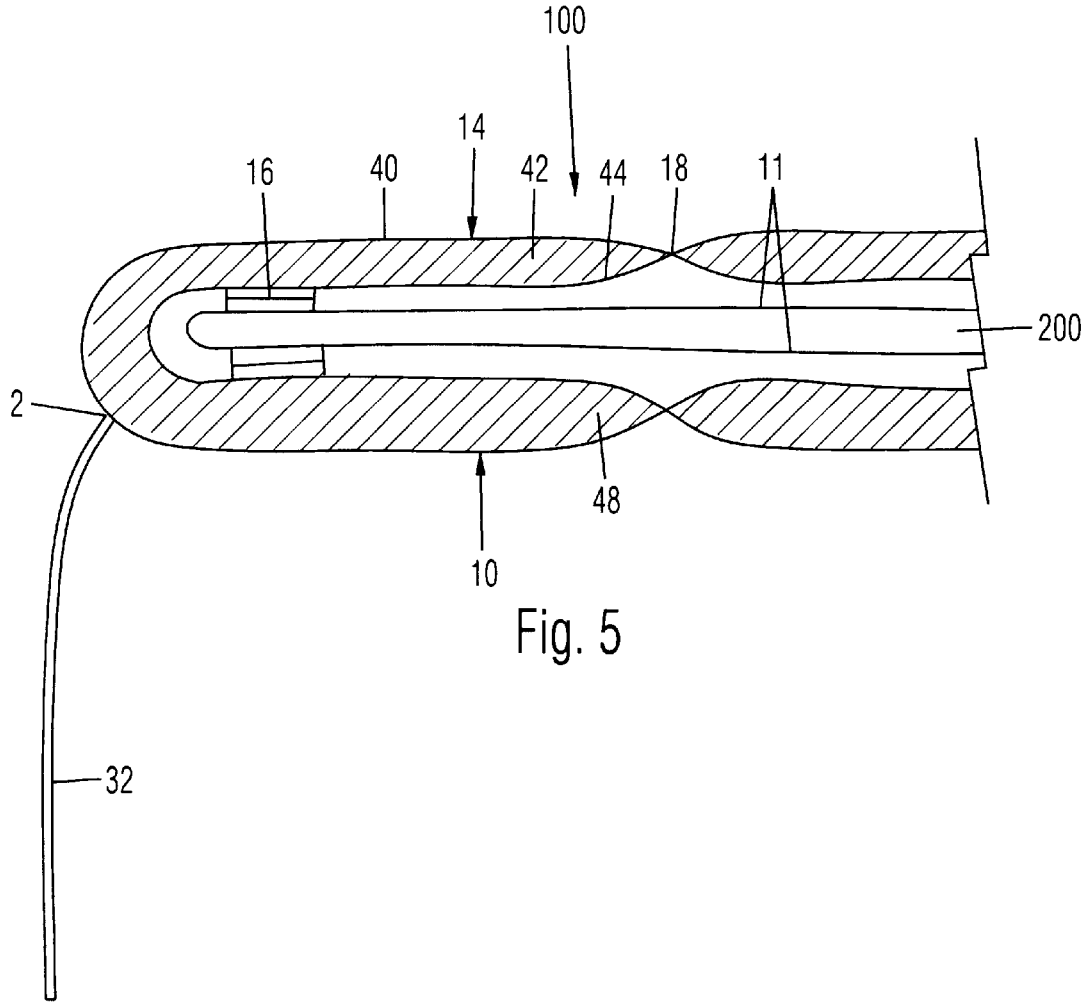
FIG. 5 is an enlarged section view of the bedding of the present invention

FIG. 5 shows an enlarged section view of bedding 100. Here we can see that bedding half 14 is comprised of a top cover 40 made of canvass or rip stop nylon, inner batting 42 made of polyester fiber or goose down and a bottom cover 44 made of canvass, cotton or nylon. Top cover 40 and bottom cover 44 are held together by stitching 18 which is sewn in a pattern to create a quilted look as shown by dotted lines in FIG. 3. Bedding half 10 is constructed in a similar way except that batting 48 is thinner than batting 42. In this way a user can turn the bedding so that the thin batting portion 10 of the bedding 100 is facing up, the summer side, when the local environment is warm and conversely the thicker batting 48 in portion 14 can be facing up, the winter side, when the local environment is cold. Sheet material 11 is made of cotton or a cotton-polyester blend and forms the surface that the user is exposed to when lying within the cavity 200 which is formed when portion 14 and portion 10 overlap each other.

Figure 6:
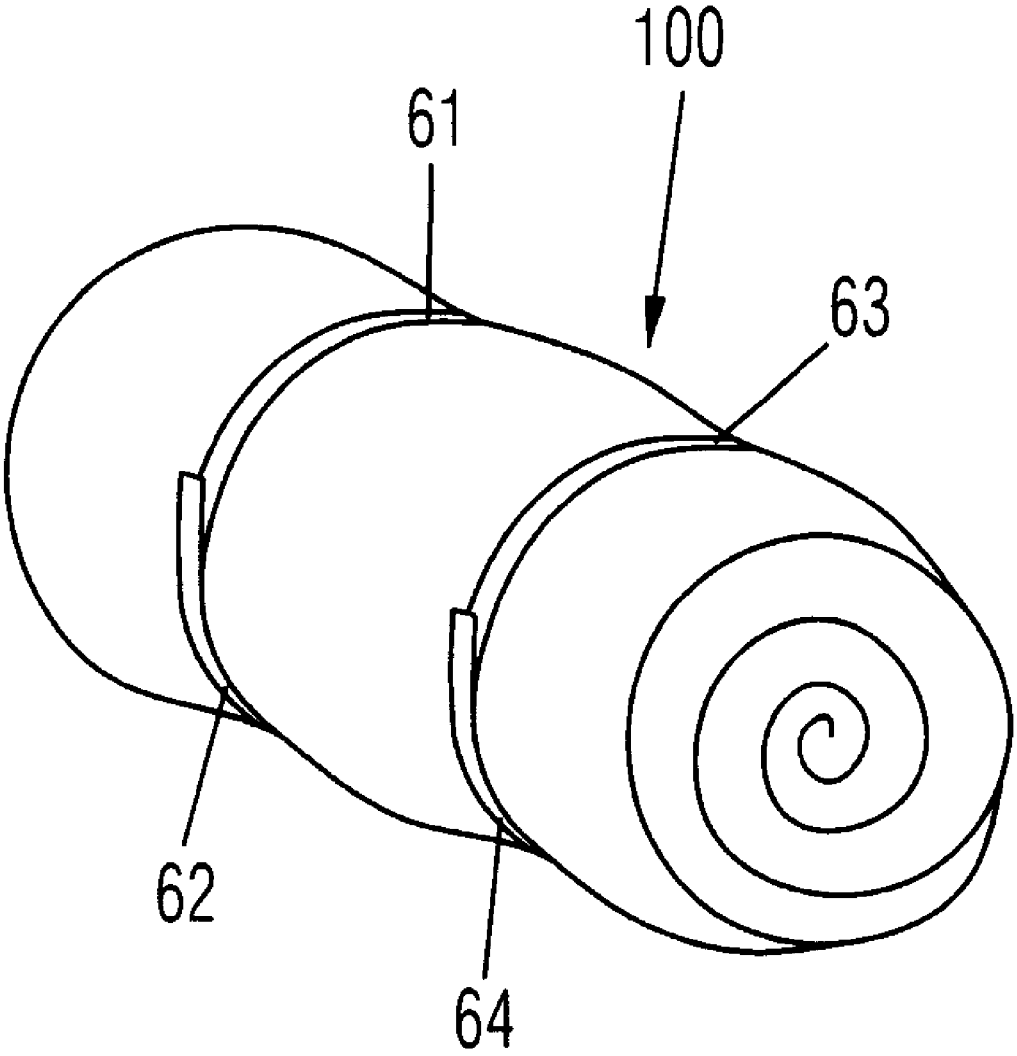
FIG. 6 is a perspective view of the bedding of the present invention in the rolled up position.

FIG. 6 shows a view of bedding 100 in the rolled up position. The bedding is held in a tight, easy to carry roll by the fastening of straps 61,62,63,64.

In the above described way, a fire fighter can quickly lay down the bedding of the present invention and create the appearance of a fully made up conventional bed. The bedding can be quickly rolled up and removed when a new fire fighter needs to occupy the bed. The bed can be comfortably used in both warm and cold environments. The attached inner sheet is removable for cleaning. Obviously, the bedding 100 of the present invention can be used by persons other than fire fighters. Such a bedding system can prove valuable to anyone who is interested in saving time and energy with regard to bed making.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A bedding, comprising:

a thinner summer section;

a thicker winter cover section connected laterally to said summer cover section along a fold line defined between respective inner sides of each said section respective outer sides of said summer cover and said winter cover being folded together but disconnected from each other;

each of said summer cover and said winter cover including an upper cloth piece and a lower cloth piece sandwiching an insulating material;

first and second side skirts respectively attached to said outer sides of said summer cover and said winter cover for shielding one of two sides of a mattress when said summer cover and said winter cover are folded together;

a plurality of end skirts attached to respective opposite ends of said summer cover and said winter cover for shielding opposite ends of said mattress; and a third side skirt attached to said fold between said summer cover and said winter cover for shielding another one of said two sides of said mattress;

whereby when said summer cover and said winter cover are folded together along said fold, said summer cover and said winter cover are adapted for receiving a person therebetween, said summer cover for being positioned on top of said person during summer, said winter cover for being positioned on top of said person during winter;

said first and second side skirts and said third side skirt always shielding said two sides of said mattress regardless of a stacking order of said summer cover and said winter cover.

2. A bedding, comprising:

a thinner summer cover section;

a thicker winter cover section connected laterally to said summer cover section along a fold line defined between respective inner sides of each said sections, respective outer sides of said summer cover and said winter cover being folded together but disconnected from each other;

each of said summer cover and said winter cover including an upper cloth piece and a lower cloth piece sandwiching an insulating material;

first and second side skirts respectively attached to said outer sides of said summer cover and said winter cover for shielding one of two sides of a mattress when said summer cover and said winter cover are folded together;

a plurality of end skirts attached to respective opposite ends of said summer cover and said winter cover for shielding opposite ends of said mattress;

a third side skirt attached to said fold between said summer cover and said winter cover for shielding another one of said two sides of said mattress;

a removable sheet with a first portion attached to an inner surface of said summer cover for simultaneous movement therewith, and a second portion attached to an inner surface of said winter cover for simultaneous movement therewith;

when said summer cover and said winter cover are folded together along said fold, said first portion and said second portion of said removable sheet are folded together and forming a space therebetween for receiving a person, said first portion of said removable sheet lining said summer cover, said second portion of said removable sheet lining said winter cover;

said summer cover for being positioned on top of said person during summer, said winter cover for being positioned on top of said person during winter;

said first and second side skirts and said third side skirt always shielding said two sides of said mattress regardless of a stacking order of said summer cover and said winter cover.

3. A bedding, comprising:

a thinner summer cover section;

a thicker winter cover section connected laterally to said summer cover section along a fold line defined between respective inner sides of each said sections, respective outer sides of said summer cover and said winter cover being disconnected from each other;

each of said summer cover and said winter cover including an upper cloth piece and a lower cloth piece sandwiching an insulating material;

first and second side skirts respectively attached to said outer sides of said summer cover and said winter cover for shielding one of two sides of a mattress when said summer cover and said winter cover are folded together;

a plurality of end skirts attached to respective opposite ends of said summer cover and said winter cover for shielding opposite ends of said mattress;

a third side skirt attached to said fold between said summer cover and said winter cover for shielding another one of said two sides of said mattress;

a pair of slits extending partially along said fold from opposite ends of said fold;

whereby when said summer cover and said winter cover are folded together along said fold, said summer cover and said winter cover are adapted for receiving said person therebetween;

said summer cover for being positioned on top of said person during summer, said winter cover for being positioned on top of said person during winter;

said first and second side skirts and said third side skirt always shielding said two sides of said mattress regardless of a stacking order of said summer cover and said winter cover;

since said outer sides of said summer cover and said winter cover are disconnected from each other, said slits enable said summer cover and said winter cover to be fully turned down.

* * * * *